United States Patent [19]

MacNeilage

[11] 4,056,120

[45] Nov. 1, 1977

[54] VALVED AUTOMOTIVE RADIATOR CAP

[76] Inventor: George C. MacNeilage, 16302 Sierra Trail Court, Hacienda Heights, Calif. 91745

[21] Appl. No.: 690,635

[22] Filed: May 27, 1976

[51] Int. Cl.[2] ..... F16K 45/00; F16K 15/00

[52] U.S. Cl. ..... 137/493.9; 220/203

[58] Field of Search ..... 137/493.1, 493.6, 322, 137/493.9; 220/203

[56] References Cited

U.S. PATENT DOCUMENTS

| | | | |
|---|---|---|---|
| 2,133,200 | 10/1938 | Kenneweg | 137/493.6 X |
| 2,356,327 | 8/1944 | Lebus | 220/203 |
| 2,582,209 | 1/1952 | Smith et al. | 220/203 |
| 3,164,288 | 1/1965 | Boomgaard | 220/203 |
| 3,381,846 | 5/1968 | Lee | 220/203 |
| 3,896,845 | 7/1975 | Parker | 137/493.6 X |
| 3,910,451 | 10/1975 | Tusing | 220/203 |

*Primary Examiner*—William R. Cline

[57] ABSTRACT

A valved automotive radiator cap which, when mounted on the filling tube of a radiator, permits water to be introduced into the interior of the radiator by use of a nozzle having a free tapered end, and the filling taking place without removing the cap from the filling tube.

1 Claim, 5 Drawing Figures

VALVED AUTOMOTIVE RADIATOR CAP

BACKGROUND OF THE INVENTION

1. Field of the Invention

Valved automotive radiator cap.

2. Description of the Prior Art

The filling of an automotive radiator is frequently conducted when the engine with which the radiator is associated has operated a sufficiently long time that the radiator cap is uncomfortably hot to the touch, and the radiator fluid will boil out of the radiator if the cap is removed.

The present invention is an automotive radiator cap valve structure that permits water to be added to a radiator without the user contacting the radiator cap, and the water being added by inserting a standard service station water nozzle having a tapered free end in a resilient body that forms a part of the invention.

A major object of the invention is to provide a valved automotive radiator cap that may remain in position on the filling tube of a radiator, and when so disposed permits the addition of water or coolant to the radiator, with the radiator cap immediately returning to a sealed position after the water filling operation is completed. Coolant may be added with a small pumping unit operated by self-contained batteries or by hooking onto the automobile battery.

SUMMARY OF THE INVENTION

The valved automotive radiator cap is incorporated into a conventional cover that removably engages the filling tube of a radiator. The cover has a centrally disposed opening therein through which an elongated valve body extends downwardly. A portion of the valve body is situated above the cover.

A resilient tubular member is supported in the upper portion of the valve body. The tubular member is in communication with a bore that extends longitudinally through the valve body. A spring loaded valve is disposed in the valve body in communication with the bore, with the valve being so biased that upward flow of liquid through the bore is blocked, but the valve opening to prevent downward flow of water through the bore when the force exerted by the water is greater than that exerted by the spring.

Water may be introduced into the radiator when a nozzle having a tapered free end portion is in pressure-sealing contact with the tubular member. Water that is pressurized may flow from the nozzle into the bore to move the valve to an open position, when the force exerted by the in-flowing water is greater than the force exerted by the spring that tends to maintain the check valve in a closed position.

The valve body supports an outwardly extending resilient member that is at all times urged into sealing contact with a circular lip that extends into the filling tube. The sealing member is urged into sealing contact with the lip by a compressed helical spring that encircles the valve body. The valve body may be moved upwardly relative to the cover to permit excess water to discharge into an overflow tube that is connected to the filling tube intermediate the cover and the sealing member, when the pressure on water in the radiator is sufficiently great as to move the sealing member upwardly relative to the lip. As soon as the excess water has discharged from the radiator into the overflow tube, the force exerted by the spring that encircles the valve body is sufficiently great as to return the valve body and sealing member to a position where the sealing member is in sealing contact with the lip. From the above description it will be seen that water may be discharged from a nozzle having a tapered free end such as is commonly used in service stations into a radiator by flowing through the invention above-described, and likewise, excess water flowing outwardly from the radiator through an overflow tube when the water in the radiator exerts greater than a predetermined pressure on the sealing member.

DESCRIPTION OF THE PREFERRED EMBODIMENT

Figure 2:
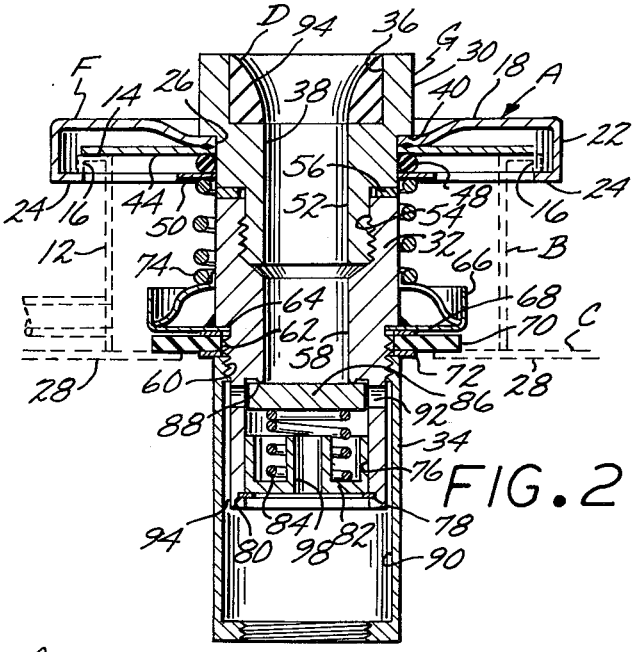
FIG. 2 is a longitudinal cross-sectional view of the device illustrated in FIG. 1 taken on the line 2—2 thereof, with the device being in a closed position.

A first form A of a valved automotive radiator cap is shown in FIG. 2 as mounted on a filling tube B of an automotive radiator C. The valved automotive radiator cap A includes a resilient tubular body D that may be sealingly engaged by a free tapered end 10 of a nozzle E that is connected to a source of pressurized water (not shown). The filling tube B is defined by a cylindrical shell 12 that has a circular flange 14 projecting outwardly from the upper end thereof, and the flange supporting a pair of oppositely disposed downwardly extending first tabs 16. The valved automotive radiator cap A includes a cover F. The cover F is defined by a generally circular plate 18 that has two oppositely disposed handles 20 projecting therefrom. The plate 18 has a cylindrical flange 22 extending downwardly therefrom as may be seen in FIG. 2, which flange supports two oppositely disposed horizontal tabs 24. The second tab 24 by rotating the plate 18 may be disposed under the first tab 16 to removably support the plate 18 on the cylindrical shell 12. The plate 18 has a center opening 26 defined therein. The shell 12 has a portion of the radiator C extending therein to define a ring-shaped lip 28 as may be seen in FIG. 2.

An elongate valve body G extends downwardly through the opening 26, with the valve body being defined by first, second and third valve body portions 30, 32, and 34 that are screw connected together and in axial alignment as illustrated in FIG. 2. The first valve body portion 30 has a cavity 36 in which the resilient tubular body D is disposed, with the cavity being in communication with a bore 38 that extends longitudinally through the first valve body portion 30. The first part 30 of valve body G has a circumferentially extending body shoulder 40 defined on the exterior thereof, which body shoulder is in abutting contact with the portion of the plate 18 adjacent the centered opening 26.

Figure 3:
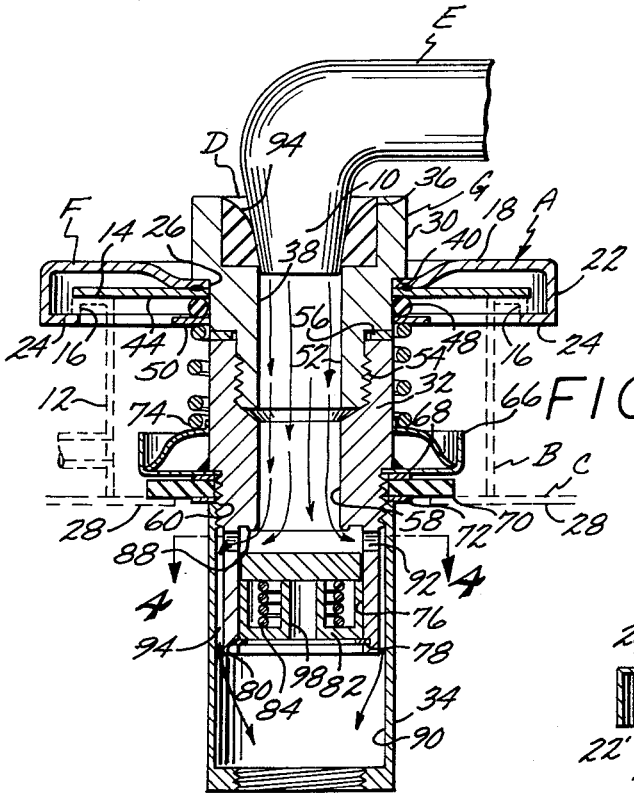
FIG. 3 is the same view as shown in FIG. 2, but with the automotive radiator cap being in in a position to permit water to flow in the radiator from a nozzle having a tapered free end portion that is in sealing contact with a resilient tubular member that forms a part of the invention.
Figure 4:
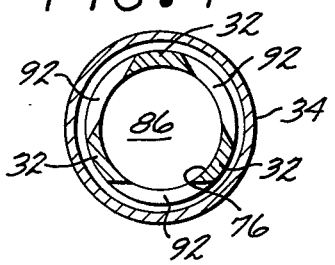
FIG. 4 is a transverse cross-sectional view of the invention as shown in FIG. 3 taken on the line 4—4 thereof.

The first part 30 of the valve body G has external threads 42 formed thereon as shown in FIG. 2. The first part 30 of valve body G is slidably movable relative to the cover F. A circular resilient sheet 44 has a centered opening 46 therein and engages the first part 30 of the valve body G below the body shoulder 40. Resilient sealing ring 48 encircles the first part 30 of valve body G below the resilient sheet 44, and is held in sealing contact with the resilient sheet 44 by a circular tab 50 that projects outwardly from the first part 30. The first part 30 of valve body G has a longitudinal bore 52 therein that is in communication with the interior of the resilient tubular body D as shown in FIG. 2. The external threads 42, as may best be seen in FIG. 2, engage internal threads 54 on the second part 32 of valve body G to hold the first and second parts 30 and 32 together in longitudinal alignment. A sealing ring 56 is situated between the abutting ends of the first and second parts 30 and 32 of the valve body G. The second part 32 has a longitudinal bore 58 therein that is in axial alignment and in communication with the bore 52. The second part 32 of valve body G has threads 60 formed on the lower extremity thereof that engages threads 62 formed on the second part 32, and when these threads are in engagement, the third part 34 of valve body G being held in axial alignment with the first and second parts 30 and 32. A body shoulder 64 is formed on the external surface of the second part 32 of valve body G. A ring-shaped spring retaining member 66, first washer 68, a ring-shaped resilient sealing member 70, and second washer 72 are gripped between the body shoulder 64 and upper end of the third part 34 of the valve body G as shown in FIG. 2. A compressed helical spring 74 encircles the second part 32 of valve body G, with the upper end of the spring being in abutting contact with the circular lip 50, and the lower end in contact with the spring retaining member 66. The bore 58 as can be seen in FIG. 2 develops into a bore 76 of larger transverse cross section which bore in the lower extremity thereof has a snap ring 78 positioned therein. The snap ring 78 is removably held in the bore 76 engaging a groove 80 of circumferential configuration. The bore 76 and snap ring 78 cooperate to support a spring retainer 82. The retainer 82 is engaged by the lower end of a compressed helical spring 84 that extends upwardly and at all times tends to move a valve member 86 into sealing engagement with a valve seat 88 defined in the second part 32 of the valve body G. The third part 34 of valve body G has a circumferentially extending bore 90 defined therein that is of substantially larger transverse cross-section than the portion of the second part 32 of valve body G that is disposed therein. The second part 32 of valve body G has a number of transverse ports 92 formed therein below the valve seat 88. When the valve member 86 moves downwardly to the position illustrated in FIG. 3, water may flow downwardly through the bore 52, 58 and ports 92 into the radiator C. The resilient tubular body D has a ring-shaped inwardly tapering surface 94 that may be sealingly engaged by the inwardly tapering free end 10 of the nozzle E. Pressurized water may flow from the nozzle E downwardly through the bores 52 and 58 to the valve member 86, and if the pressure exerted by the inflowing water on the valve member 86 is greater than the force 84 exerted on the valve member, the valve member will move downwardly to the second position illustrated in FIG. 3 where water may flow through the ports 92 and annulus space 94 to discharge from the invention A into the radiator C. When the radiator is filled, water will flow upwardly through the passage 96 in the spring retainer 82 to exert a force on the lower surface of the valve member 86, and this force together with that exerted by the spring 84 will force the valve member 86 upwardly to seal with the valve seat 88 as shown in FIG. 2.

Figure 5:
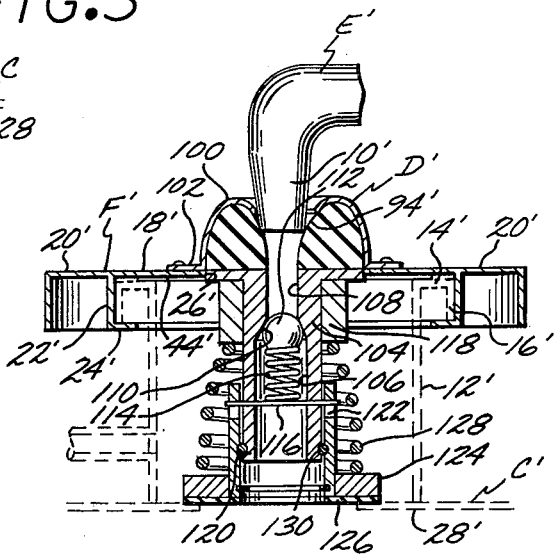
FIG. 5 is a longitudinal cross-sectional view of a second form of the valved automotive radiator cap.

A second form A′ of the valved radiator cap is shown in FIG. 5 that is adapted to be disposed on a filling tube B′ of a radiator C′. The second form A′ serves the same function as the first form A but is of simpler structure than the latter. The filling tube B′, radiator C′ and cover F′ are of the same general structure as the filling tube B, radiator C and cover F previously described. Elements of the filling tube B′, radiator C′, and cover F′ previously described are identified by the same numerals previously used but with primes added thereto.

A circular clip 100 that has an outwardly extending flange 102 holds resilient member D′ within the confines thereof and axially aligned with opening 26′. A valve body 104 is secured to plate 18′ by conventional means and extends downwardly therefrom.

Valve body 104 has a longitudinal bore 106 therein that is in communication with a counter bore 108. Bore 106 and counter bore 108 at their junction define a tapered valve seat 110. A ball 112 tends to be held at all times in sealing contact with seat 110 by a compressed longitudinally extending first helical spring 114 that has the lower end thereof in abutting contact with a transverse pin 116. Pin 116 is supported in transversely aligned bores in valve body 104. The pin 116 has end portions that project from valve body 104. A collar 118 encircles the upper part of valve body 104.

A tubular member 120 is slidably mounted on valve body 104. Tubular member 120 has a pair of oppositely disposed longitudinal slots 122 therein that slidably engage the projecting ends of pin 116. A ring-shaped valve member 124 projects outwardly from the lower end of tubular member 120. Valve member 124 has a sheet of resilient material 126 secured to the underside thereof as shown in FIG. 5. A second compressed helical spring 128 encircles tubular member 124, with one end of the spring in contact with collar 118 and the opposite end abutting against the valve member 124.

Figure 1:
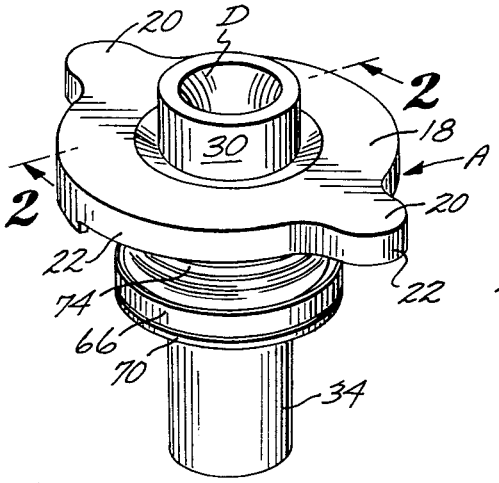
FIG. 1 is a perspective view of a first form of the valved automotive radiator cap.

The valved automotive radiator cap A as shown in FIG. 1 may be mounted on the filling tube B of an automotive radiator C. The cap A includes a resilient tubular body D that may removably seal with the tapered free end portion 10 of a nozzle E that is connected by conventional means, such as a flexible hose (not shown) to a source of water under pressure likewise not shown.

An O-ring 130 is mounted on the external surface of valve member 104 and is in slidable sealing contact with the interior surface of tubular member 120. When the cover F′ is mounted on filling tube B′ as shown in FIG. 5, the resilient sheet 44′ is in sealing engagement with circular flange 14, and valve member 124 sealing with ring-shaped lip 28′.

When water discharges from nozzle E′ into the invention A′ to exert a force on ball 110 greater than the force exerted by first spring 114, the ball moves downwardly from the valve seat 110, and water flows into the radiator C′. After the radiator C′ has been filled the pressure of water above and below the ball 112 is the same and the spring returns the ball to a seated position.

The use and operation of the first and second forms A and A′ of the invention have been described previously in detail and need not be repeated.

I claim:

1. A valved radiator cap assembly capable of being removably mounted on a filling tube of an automotive radiator of the type that includes a cylindrical shell having first and second ends, a flat circular flange extending outwardly from said first end, a pair of oppositely disposed first tabs depending from said flange, and a ring-shaped lip projecting inwardly from said second end of said shell, said shell having an opening therein between said first and second ends that is in communication with an overflow line, said assembly permitting water under pressure to be discharged into said radiator from a nozzle having a tapered end without removing said assembly from said filling tube, said assembly permitting water and steam to escape from said radiator through said opening to said overflow line when the pressure in said radiator rises above a predetermined level, said assembly permitting a negative pressure in said radiator to be partially relieved by flow of air thereinto from the ambient atmosphere as said radiator cools, said assembly including:

a. a cover removably mounted on said first end of said shell, said cover including a pair of oppositely disposed second tabs that engage said first pair of tabs to maintain said cover on said filling tube, said cover having a central opening therein;

b. an exteriorly disposed tubular resilient body that projects outwardly from said cover, is permanently secured to said cover, and is in communication with said central opening, with said resilient body capable of being sealingly engaged by said nozzle when the latter is in pressure contact with said body;

c. an elongate valve body that depends from said cover, said valve body having a bore and a counterbore therein, said counterbore in communication with said central opening, and said bore and counterbore at their junction defining and inward and upwardly tapering valve seat;

d. a rigid ball longitudinally movable in said bore and capable of sealingly engaging said valve seat, said ball of less diameter than that of said bore;

e. a transverse pin supported by said valve body below said ball, said pin having outwardly projecting end portions;

f. a first compressed helical spring disposed in said bore with one end thereof in abutting contact with said ball and the other end in contact with said pin, said first spring having a compression ratio sufficient to maintain said ball in sealing contact with said seat with a first force to permit water to flow from said nozzle through said bore when the pressure on said water is sufficiently great as to exert a second force on said ball greater than said first force;

g. a tubular member slidably and sealingly movable in a longitudinal direction on the exterior surface of said valve body, said member having a pair of oppositely disposed, elongate, longitudinal slots therein that are slidably engaged by said end portions to limit the range of movement of said tubular member relative to said valve body and to prevent inadvertent separation of said tubular member and valve body;

h. an outwardly projecting ring-shaped valve member secured to the end portion of said tubular member most remote from said first spring, said valve member having first and second oppositely disposed sides;

i. abutment defining means on said tubular member adjacent said cover;

j. a resilient sheet of material bonded to said first side of said valve member;

k. a second compressed helical spring that encircles said tubular member, said second spring having one end in contact with said abutment means and the other end in contact with said second side of said valve member, said second spring at all times tending to maintain said resilient sheet in pressure sealing contact with said ring-shaped lip with a third force, with a portion of said resilient sheet at all times in communication with the interior of said radiator, and when pressure of fluid in said radiator exerts a fourth force on said resilient sheet greater than said third force said tubular member, valve member and resilient sheet will move towards said cover to allow fluid to flow to said overflow line from said radiator until said third force is greater than said fourth force, said ball when there is a negative pressure in said radiator of sufficient magnitude will move out of sealing contact with said valve seat against the first force of said first spring to allow air from the ambient atmosphere to flow into said radiator until said first force returns said ball to sealing engagement with said valve seat.

* * * * *